US010680369B2

(12) United States Patent
Zhao

(10) Patent No.: US 10,680,369 B2
(45) Date of Patent: Jun. 9, 2020

(54) ELECTRICAL CONNECTOR CONTACTS PLATED WITH AN ELECTROPHORETIC DEPOSITION COATING AND A PRECIOUS-METAL-ALLOY COATING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/191,438

(22) Filed: Nov. 15, 2018

(65) Prior Publication Data

US 2019/0148864 A1 May 16, 2019

(30) Foreign Application Priority Data

Nov. 15, 2017 (CN) ..... 2017 1 1125744

(51) Int. Cl.

| | |
|---|---|
| ***H01R 13/02*** | (2006.01) |
| ***H01R 13/03*** | (2006.01) |
| ***H01R 43/00*** | (2006.01) |
| ***H01R 13/405*** | (2006.01) |
| ***H01R 43/16*** | (2006.01) |
| ***C25D 7/06*** | (2006.01) |

(52) U.S. Cl.
CPC ..... *H01R 13/03* (2013.01); *C25D 7/06* (2013.01); *H01R 13/405* (2013.01); *H01R 43/00* (2013.01); *H01R 43/16* (2013.01)

(58) Field of Classification Search
CPC ..... H01R 13/03; H01R 13/405; H01R 43/00; H01R 43/16; C25D 7/06
USPC ..... 439/886, 887, 660
See application file for complete search history.

(56) References Cited

U.S. PATENT DOCUMENTS 5,354,205 A * 10/1994 Feigenbaum ..... G01R 1/073 205/78
5,364,277 A * 11/1994 Crumly ..... C07J 61/00 439/67
5,812,378 A * 9/1998 Fjelstad ..... G01R 1/0466 257/E23.067

(Continued)

FOREIGN PATENT DOCUMENTS

CN 105375157 A 3/2016

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

A method of manufacturing electrical connector contacts includes the steps of: forming a row of contacts each having a front contacting portion, a rear soldering portion, and a securing portion between the front contacting portion and the rear soldering portion; forming an electrophoretic deposition (ED) coating on the contacting portions of the row of contacts; removing a respective front region of ED coating on the contacting portion; and forming a precious-metal-alloy coating on the front regions removed of ED coating.

6 Claims, 5 Drawing Sheets

(56) References Cited

U.S. PATENT DOCUMENTS

| | | | | |
|---|---|---|---|---|
| 5,967,860 | A * | 10/1999 | Ricketts | B32B 15/01 420/501 |
| 6,117,694 | A * | 9/2000 | Smith | H01L 23/4985 438/118 |
| 6,239,386 | B1 * | 5/2001 | DiStefano | H01R 13/2414 174/262 |
| 8,334,961 | B2 * | 12/2012 | Montbach | C09K 19/544 257/72 |
| 8,936,857 | B2 * | 1/2015 | Dadvand | B32B 15/018 428/673 |
| 2002/0164893 | A1 * | 11/2002 | Mathieu | G01R 1/06727 439/66 |
| 2008/0307646 | A1 * | 12/2008 | Zaderej | F21V 19/0015 29/874 |
| 2012/0149257 | A1 * | 6/2012 | Malervy | C25D 5/10 439/886 |
| 2013/0084760 | A1 * | 4/2013 | Siahaan | H01R 13/03 439/887 |
| 2013/0164982 | A1 * | 6/2013 | Zhang | H01R 13/03 439/607.46 |
| 2015/0111436 | A1 * | 4/2015 | Zhang | H01R 13/405 439/676 |
| 2017/0271800 | A1 | 9/2017 | Wagman et al. | |
| 2018/0030608 | A1 | 2/2018 | Kwok et al. | |
| 2019/0148864 | A1 * | 5/2019 | Zhao | H01R 13/405 439/660 |

* cited by examiner

ELECTRICAL CONNECTOR CONTACTS PLATED WITH AN ELECTROPHORETIC DEPOSITION COATING AND A PRECIOUS-METAL-ALLOY COATING

BACKGROUND OF THE INVENTION

1. Field of the Invention

The present invention relates to a method of manufacturing electrical connector contacts, comprising the steps of forming an electrophoretic deposition (ED/EPD) coating on contacting portions of a row of contacts, removing a respective front region of ED coating on the contacting portion, and forming a precious-metal-alloy coating on the front regions removed of ED coating.

2. Description of Related Arts

U.S. Patent Application Publication No. 2017/0271800 discloses an embodiment of a contact that is partially plated with plastic, resin, or other material. In this embodiment, a plastic insulating layer or coating may be formed using electrophoretic deposition (ED) or other appropriate method. This layer or coating may cover primarily a beam of a contact to present corrosion while a contacting portion of the contact may remain exposed so as to form an electrical connection with a mating connector contact. During manufacturing such a contact, a masking layer may be applied to a contact area mechanically, e.g., by printing. After the ED coating has been applied, the masking layer may be removed. For example, where the masking layer is wax, it may be removed using hot water.

SUMMARY OF THE INVENTION

A method of manufacturing electrical connector contacts comprises the steps of: forming a row of contacts each having a front contacting portion, a rear soldering portion, and a securing portion between the front contacting portion and the rear soldering portion; framing an electrophoretic deposition (ED) coating on the contacting portions of the row of contacts; removing a respective front region of ED coating on the contacting portion; and forming a precious-metal-alloy coating on the front regions removed of ED coating.

DETAILED DESCRIPTION OF THE PREFERRED EMBODIMENT

Referring to FIGS. 1-5, an electrical connector 100 comprises an insulative housing 1 and at least one row of contacts 2 secured to the insulative housing. In the embodiment shown the contacts 2 include an upper row of contacts and a lower row of contacts, reversely-symmetrically arranged as is well known in this art.

Figure 1:
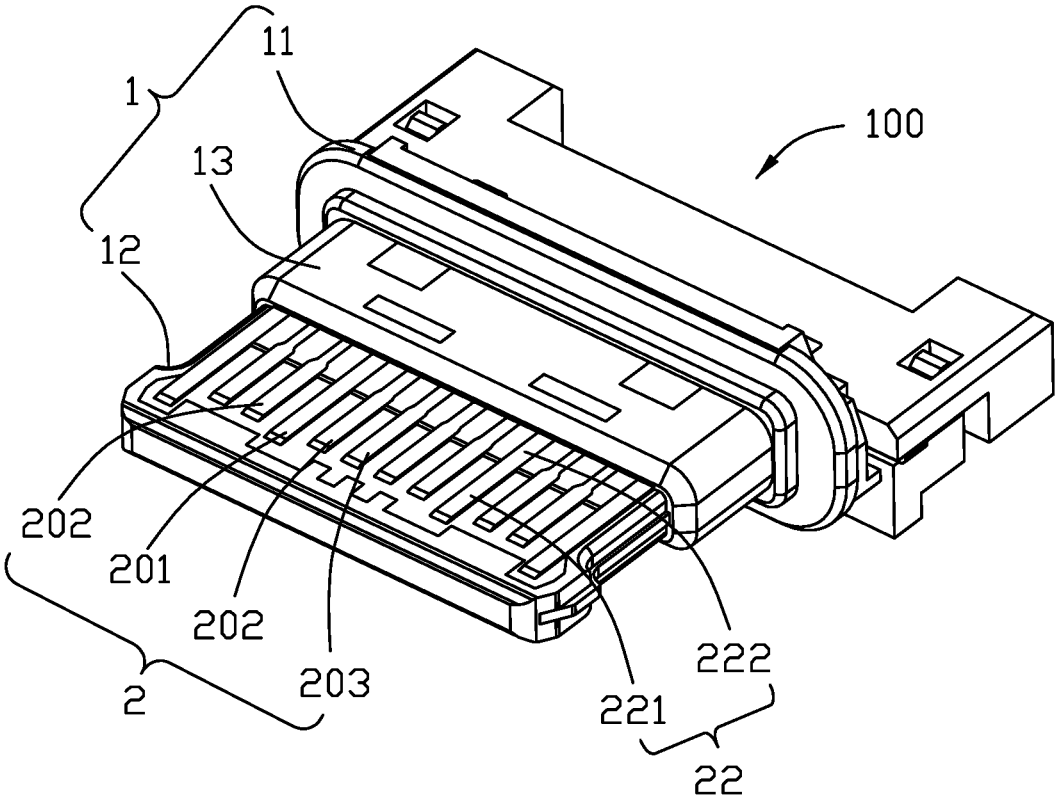
FIG. 1 is a front and top perspective view of an electrical connector having contacts manufactured in accordance with the present invention.
Figure 2:
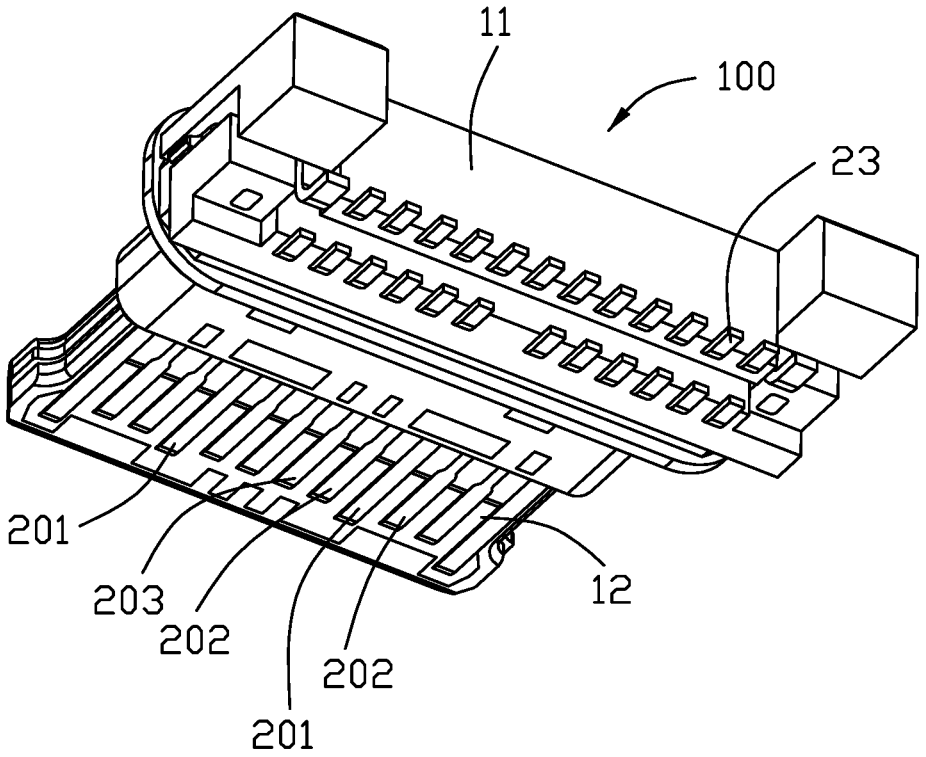
FIG. 2 is a rear and bottom perspective view of the electrical connector.
Figure 3:
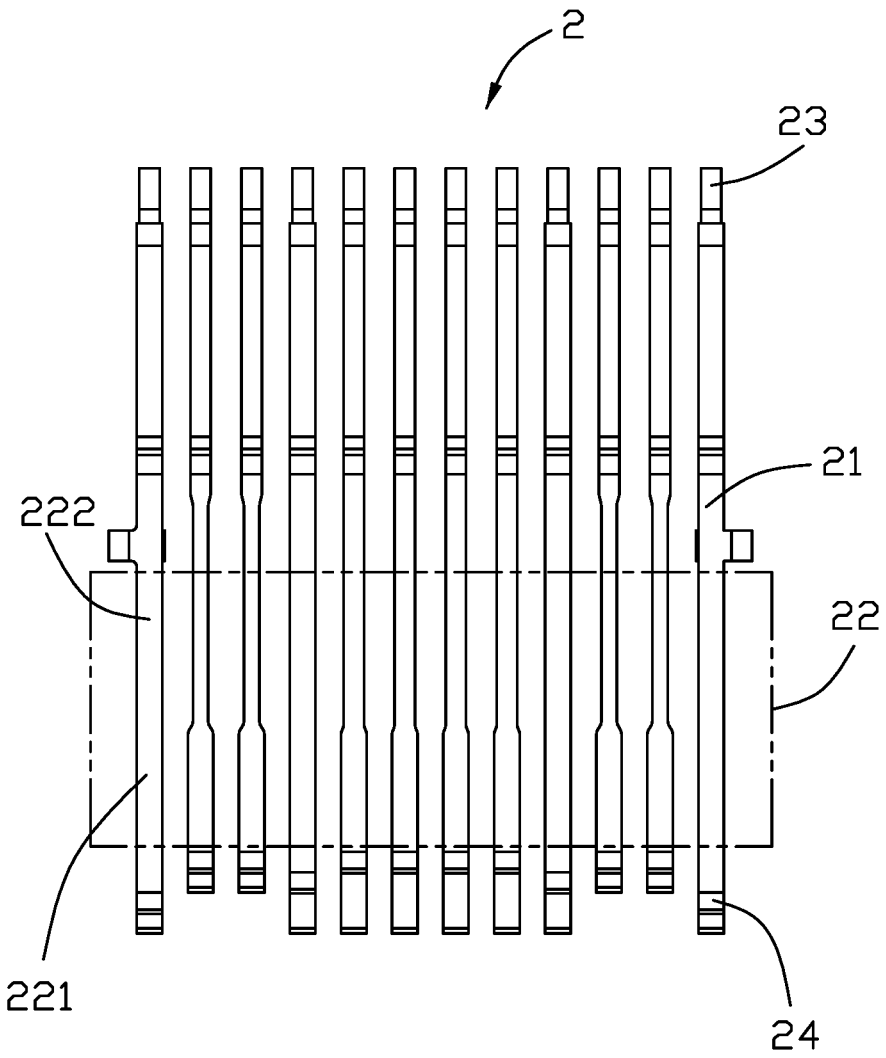
FIG. 3 is a top plan view of a row of contacts before forming an electrophoretic deposition (ED) coating thereon.

Referring specifically to FIGS. 1-3, the insulative housing 1 has a base 11 and a tongue 12. Each of the contacts 2 has a retaining portion 21 secured to the base 11, a contacting portion 22 exposed to the tongue 12, and a rear soldering portion 23. Each of the upper row of contacts and the lower row of contacts includes a power contact 201, contacts 202 on two sides of the power contact, and other contacts 203. Each contacting portion 22 includes a front contacting region 221 for contacting a mating terminal of a complementary connector and a rear non-contacting region 222 that does not contact the mating terminal. Each contacting portion 22 may further include an embedded section 24.

Figure 4:
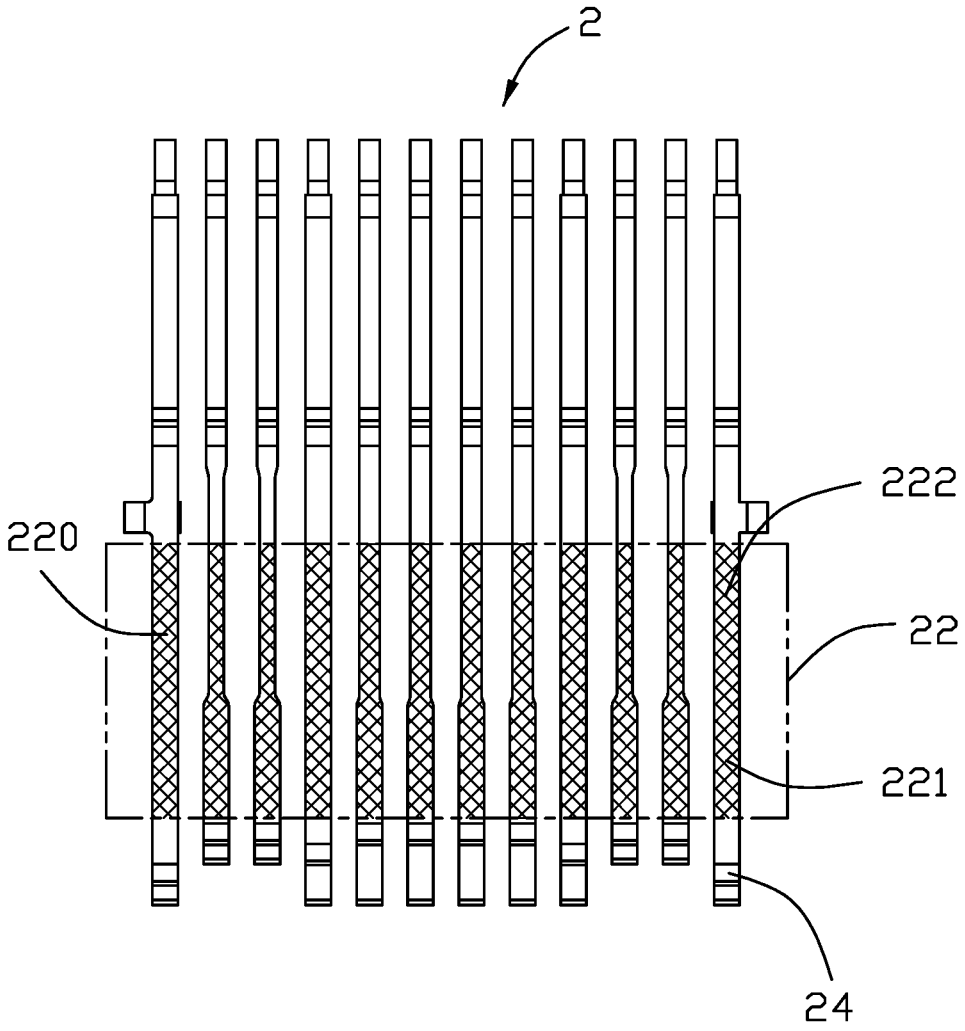
FIG. 4 is a view similar to FIG. 3, showing that an ED coating is formed on contacting portions of the row of contacts.
Figure 5:
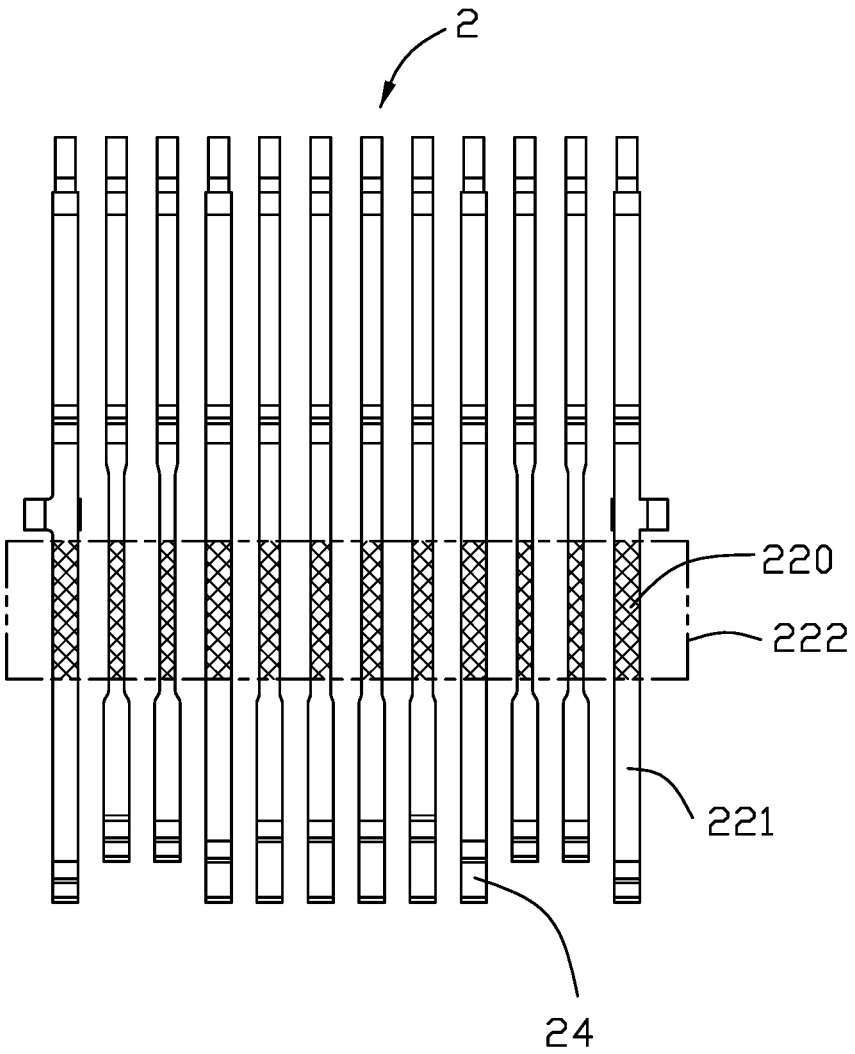
FIG. 5 is a view similar to FIG. 3, showing that a respective front region of ED coating on the contacting portion is removed.

Referring specifically to FIGS. 3-5, in order to prevent the contacts 2 from corrosion, the non-contacting regions 222 are formed with an electrophoretic deposition (ED) coating 220 while the contacting regions 221 are without the ED coating. In manufacturing, the contacting portions 22 are firstly formed with an electrophoretic deposition (ED) coating. Then, the ED coating formed on the contacting regions 221 is removed by laser engraving while the ED coating formed on the non-contacting regions 222 remains. Finally, a high-conductivity coating, e.g., a precious-metal-alloy coating, is formed on the contacting regions 221 where ED coating had been removed. Preferably, the high-conductivity coating is gold. The precious-metal-alloy coating may comprise one of a base metal, e.g, nickel, or other noble metal, e.g., silver or palladium. If desired, the embedded sections 24 may also be formed with ED coating. If the power contacts 201 on both rows were to be in contact for conducting large current, the embedded sections 24 thereof need not be ED coated.

A step portion 13 may be formed between the base 11 and the tongue 12 where the non-contacting regions 222 are located, exposed and tending to accumulate liquid and apt to corrosion. The ED coating may also be formed only at the non-contacting region 222 of the power contact 201 which is more apt to corrosion compared to the other contacts.

What is claimed is:

1. A method of manufacturing electrical connector contacts, comprising the steps of:

forming a row of contacts each having a front contacting portion, a rear soldering portion, and a securing portion between the front contacting portion and the rear soldering portion;

forming an electrophoretic deposition (ED) coating on the contacting portions of the row of contacts;

removing a respective front region of ED coating on the contacting portion; and forming a precious-metal-alloy coating on the front regions removed of ED coating.

2. The method as claimed in claim 1, wherein the precious-metal-alloy coating comprises one of a base metal or a noble metal.

3. The method as claimed in claim 2, wherein the precious-metal-alloy coating comprises one of silver, nickel, or palladium.

4. A method of manufacturing electrical connector contacts, comprising the steps of:

forming a row of contacts each having a front contacting portion, a rear soldering portion, and a securing portion between the front contacting portion and the rear soldering portion, the contact portion including a front region and a remaining region;

applying an electrophoretic deposition (ED) coating at least on the remaining regions of the contacting portions of the row of contacts; and applying a precious-metal-alloy coating on the front regions of the contacting portions of the contacts; wherein the front regions of the contacting portions of the contacts are excluded from the ED coating in the finalized contacts.

5. The method as claimed in claim 4, wherein the precious-metal-alloy coating comprises one of a base metal or a noble metal.

6. The method as claimed in claim 5, wherein the precious-metal-alloy coating comprises one of silver, nickel, or palladium.

* * * * *